United States Patent [19]

Dahm

[11] Patent Number: 4,658,699

[45] Date of Patent: Apr. 21, 1987

[54] WAVE GUN

[75] Inventor: Thomas J. Dahm, Los Altos, Calif.

[73] Assignee: Astron Research and Engineering, Mountain View, Calif.

[21] Appl. No.: 775,697

[22] Filed: Sep. 13, 1985

Related U.S. Application Data

[63] Continuation-in-part of Ser. No. 530,921, Sep. 12, 1983, abandoned.

[51] Int. Cl.[4] ..... F41F 1/00; F42B 5/02

[52] U.S. Cl. ..... 89/8; 102/440

[58] Field of Search ..... 89/7, 8

[56] References Cited

U.S. PATENT DOCUMENTS 3,054,329 9/1962 Willig ..... 89/8 X
3,126,789 3/1964 Meyer ..... 89/8
3,311,020 3/1967 Piacesi et al. ..... 89/8
3,326,084 6/1967 Barbieri et al. ..... 89/7
3,496,827 2/1970 Dardick ..... 102/440 X

FOREIGN PATENT DOCUMENTS 721289 4/1942 Fed. Rep. of Germany ..... 102/443

*Primary Examiner*—David H. Brown
*Attorney, Agent, or Firm*—Romney Golant Martin Seldon & Ashen

[57] ABSTRACT

A two-stage gas launcher is disclosed wherein a low molecular weight gas such as hydrogen or helium is compressed to a high pressure within the bore of the launcher by a low mass, propellant-driven piston. A releasably restrained projectile is abruptly released so as to be launched from the bore at a high velocity by the pressure of the compressed low molecular weight gas.

22 Claims, 3 Drawing Figures

WAVE GUN

Figure 1:
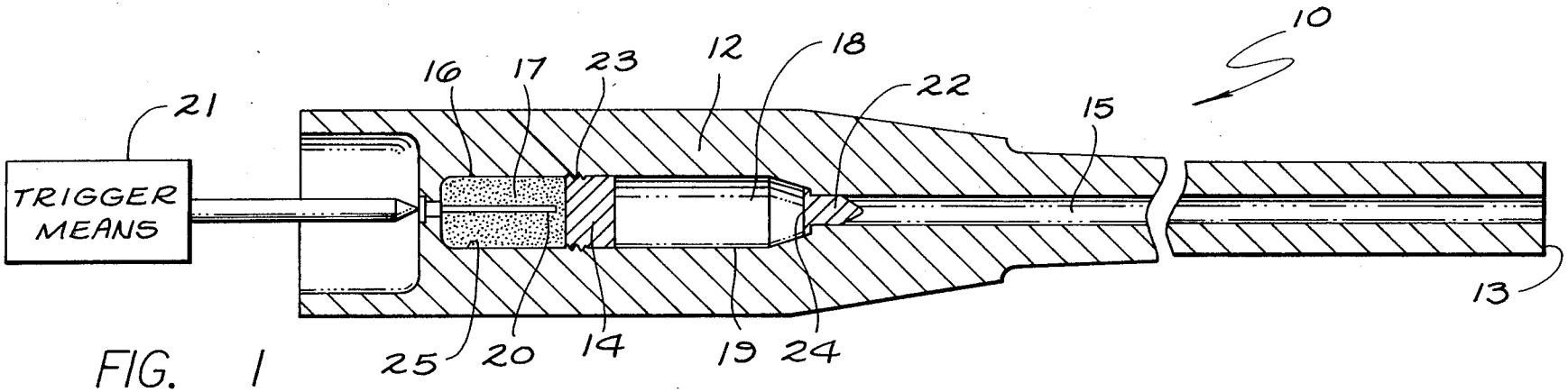

This is a continuation-in-part of copending application Ser. No. 530,921 filed on 9/12/83, now abandoned.

The present invention relates to launchers and, more particularly, to light gas launchers.

One application for such launchers is the so called light gas gun. Light gas guns can impart a muzzle velocity of as much as 10 kilometers per second to the launched projectile compared with typical velocities of 1.5 kilometers per second or less from conventional guns.

Those skilled in the art know that the attainable muzzle velocity is limited largely by the chemical energy released per unit of mass of propellant used (which increases with flame temperature) and by the molecular weight of the gaseous combustion products. Temperature and molecule weight together effect the sound speed in the gaseous working fluid. Specifically the speed of sound varies with the temperature and molecular weight of the fluid according to the equation:

$$V_s \propto \sqrt{\frac{T}{M}} \quad (1)$$

where:

$V_s$=sound speed

T=temperature

M=molecular weight

In conventional guns, wherein either a liquid or solid propellant is used, the temperature limit is approximately 3000° K. while the minimum obtainable molecular weight of the combustion products is approximately 20. To increase muzzle velocity, the sound speed of the propellant must be increased, by increasing the temperature of the propellant and/or decreasing the molecular weight of the combustion products.

Two stage light gas guns have accordingly been disclosed in the art which employ a low molecular weight gas such as hydrogen or helium as the projectile-pushing fluid. The gas is compressed to a high pressure and moderately high temperature within a bore between a propellant driven piston and a releasably restrained projectile in the bore. The projectile is abruptly released and expelled from the bore at high velocity by the pressure of the compressed low molecular weight gas.

In conventional two-stage gas guns, a chemical propellant, similar to that used in conventional weapons, is ignited and expands against the piston. The piston travels forward and compresses the low-molecular weight gas, sometimes referred to as the second stage propellant to distinguish it from the first stage chemical propellant. When the pressure in the second stage is typically about 0.5 to 5 Kbar, the projectile is released. The compressed gas then accelerates the projectile down the "launch tube", or barrel, of the gas gun.

The first stage propellant has burned completely during the forward movement of the piston. Accordingly, the pressure behind the piston decreases with further forward movement of the piston. Simultaneously, the pressure ahead of the piston is increasing with forward piston travel; the result is a slowing of the piston as it travels forward. At the point of zero forward velocity, the pressure behind the piston is less than the front pressure because of piston inertia, and the piston begins to travel backwards.

Ideally, the projectile of the conventional two stage gas gun is released just prior to the zero-velocity point of the piston, since second stage pressure is then approaching a maximum. As the projectile travels down the launch tube, and the piston is traveling backwards, the second stage propellant expands to fill the increasing launch tube volume behind the forward-moving projectile. Consequently, the pressure in the second stage decreases, with the pressure eventually decreasing to atmospheric when the second stage propellant escapes out of the launch tube after the projectile is launched. After the second stage pressure falls below the first stage pressure on the backside of the piston, backward travel of the piston ceases and the piston travels forward once again to impact with the convergence area where the launch tube and second stage chamber meet. In some applications, the piston is intentionally impacted with the convergence area at the end of the first forward motion to provide a strong projectile propulsion pulse.

The sequence of events described above is generally fast. The elapsed time from the beginning of the piston's forward motion to the instant of maximum second stage pressure is in the order of 10 msec., depending on gun size and particular design. The time from projectile release to projectile launch is typically approximately one-half the compression time.

Each time the gun is fired, the first and second stage propellants, the primer/igniter, the projectile, and projectile restraining element must be replaced. Additionally, the piston will also need to be replaced because its impact with the convergence area will create deformities. The rapid replacement of all these components is highly desirable for obvious practical reasons.

U.S. Pat. No. 3,326,084, discloses a light gas cartridge wherein the piston, propellant and projectile are provided as a proloaded cartridge. Because the piston is disposable and the cartridge should be as light as practical, the piston is desirably formed from a low mass of material.

Conventionally, however, known light gas guns built as laboratory devices have required relatively massive pistons to perform well. Such pistons move relatively slowly and remain at a position of maximum compression for a relatively long period to permit optimum projectile launch without the timing of projectile release becoming particularly critical. Further, compression of the second stage propellant, the time interval of maximum compression and the consequential muzzle velocity, have been maximized by a piston having relatively large inertia. Accordingly, conventional two stage light gas guns have not been able to utilize a cartridge such as that taught in the aforementioned patent. Because of the stores weight and attendant handling loads associated with the piston mass in such a cartridge, the potential for realizing rapid firing of a two stage light gas gun through use of a cartridge has been negated.

The wave gun described herein exploits the performance potential of light gas guns but employs novel internal ballistics that makes a relatively compact configuration capable of high rates of fire possible.

Specifically, the wave gun described herein eliminates the need for a massive piston of the type conventionally believed to be necessary. Instead, the piston is of relatively low mass and can be replaced by any separating medium such as a rolling seal or a relatively low mass obturator which functions only as a barrier to prevent the mixing of first and second stage propellants. For convenience, the term "piston" will be used to include these alternative structures and their equivalents.

Further, means such as a suitably slow-burning first stage propellant is utilized so that the piston will reach its position of zero velocity and thereafter experience a reciprocating motion while the propellant burns. Continued burning during reciprocation allows sustained high piston-base pressures. As a consequence, the piston can be maintained near the convergence area by pressure rather than inertia as in the conventional two-stage gun cycle. Therefore, the piston can be lighter than that of the conventional two-stage gas gun.

The frequency of reciprocation is inversely related to the piston mass. The projectile is released at a selected time during the piston reciprocation. The reciprocation frequency of the wave gun can be sufficiently high to cause at least a secondary wave to overtake the released projectile before it is launched and add to its muzzle velocity.

An additional benefit obtainable from the reciprocating action of the piston, while maintaining propellant combustion, is the progressively greater second stage pressures obtained in each compression stroke of the piston without exceeding the critical pressure of the gun.

The gas launcher herein comprises a housing including a launch tube section at its distal end, and barrier means in the housing for sealingly dividing the housing into first-stage and second-stage chambers of reciprocally variable volume. Means responsive to a trigger signal cause a plurality of volumetric expansions of the first chamber during a period of sustained high mean pressure therein. A low molecular weight gas is disposed in the second-stage chamber for compression by the volumetrically expanding first-stage chamber. A launchable mass is positioned in the housing and responsive to the pressure of the compressed second-stage gas to travel along the launch tube section and to be launched from the distal end thereof. Means are provided for releasably restraining the launchable mass within the housing so that it is launched during the period of sustained high pressure in the first-stage chamber.

A cartridge for the gas launcher can accordingly be constructed comprising a generally tubular housing having a launch end, barrier means for sealingly dividing the housing into first and second-stage chambers of reciprocally variable volume, and propellant means disposed within the first-stage chamber and ignitable to cause a plurality of volumetric first-stage expansions displacing the barrier means. Ignition means responsive to a trigger signal ignites the propellant. A low molecular weight gas is disposed within the second-stage chamber for compression by the displaced barrier means. A launchable mass is releasably restrained in the launch end of the housing and positioned to be acted on by the compressed second-stage gas. Means are provided for releasing the launchable mass so that it is launched from the launcher during the period of sustained high mean pressure in the first-stage chamber.

Figure 3:
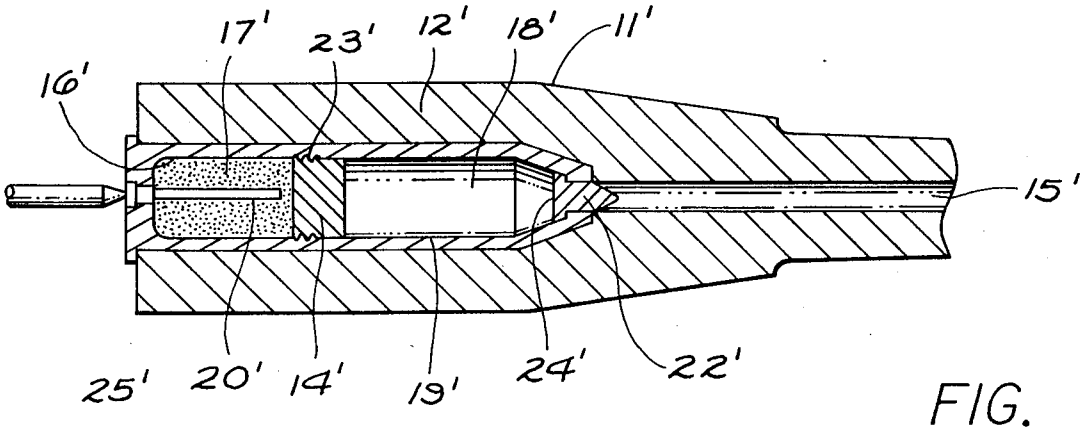

Further details and advantages of the wave gun will be appreciated by reference to the following Description of a Preferred Embodiment of which the following drawing is a part:

FIG. 1 is a sectional view in schematic of a light gas gun constructed in accordance with the invention; and FIG. 2A–I are sectional views in schematic of a typical operating cycle for a light gas gun constructed in accordance with the invention; and FIG. 3 is a sectional view in schematic of a cartridge constructed in accordance with the invention and positioned within a light gas gun.

In FIG. 1, a light gas gun 10 is illustrated as comprising a housing 11 having a pump tube section 12 and a launch tube section 15 disposed about a longitudinal axis 13 and formed, for example, from a high strength steel alloy such as 4340 steel. A piston 14 sealingly engages the inner wall of the pump tube 12 and, as described below, is adapted to travel axially therewithin. The piston 14, which can conveniently be formed from a plastic such as polypropylene, divides the pump tube into first and second-stage chambers 17,19 respectively. First stage propellant 16 in the form of a chemical propellant such as gunpowder is contained within the pump tube 12 in the first-stage chamber 17 on the rear side of the piston 14. The powder used for propellant 16 may be mixed with a material such as polystyrene balls to vary the charge density. A progressive grain powder having a packing density of 0.5 to 1 gram/cc is preferred. An ignitor 20 responsive to a trigger from trigger signal means 21 is positioned to ignite the propellant 16.

A second stage propellant 18 of low molecular weight gas such as hydrogen or helium is disposed within the pump tube 12 in the second-stage chamber 19 on the forward side of the piston 14 at a charge pressure in the range of 2–200 bars. Helium is preferred in many cases because it is inert and safer and, in certain instances, has volume advantages over hydrogen.

A projectile 22 is located at the distal end of the pump tube and is coupled thereto by a releasably restraining member 24. The member 24 may, for example, be a "shear lip" which is affixed to the inner surface of the pump tube about its outer periphery 25 and to the projectile at its center position. The center portion of the shear lip is designed to shear from the outer periphery at a predetermined pressure, preferably 0.5 to 3 Kbar, or higher, so that the projectile is released at the appropriate time within the launch sequence. Alternatively, the projectile may be restrained by an interference fit within the bore at an axially offset downstream position from a burst diaphragm designed to rupture at the appropriate time within the launch sequence.

Figure 2:
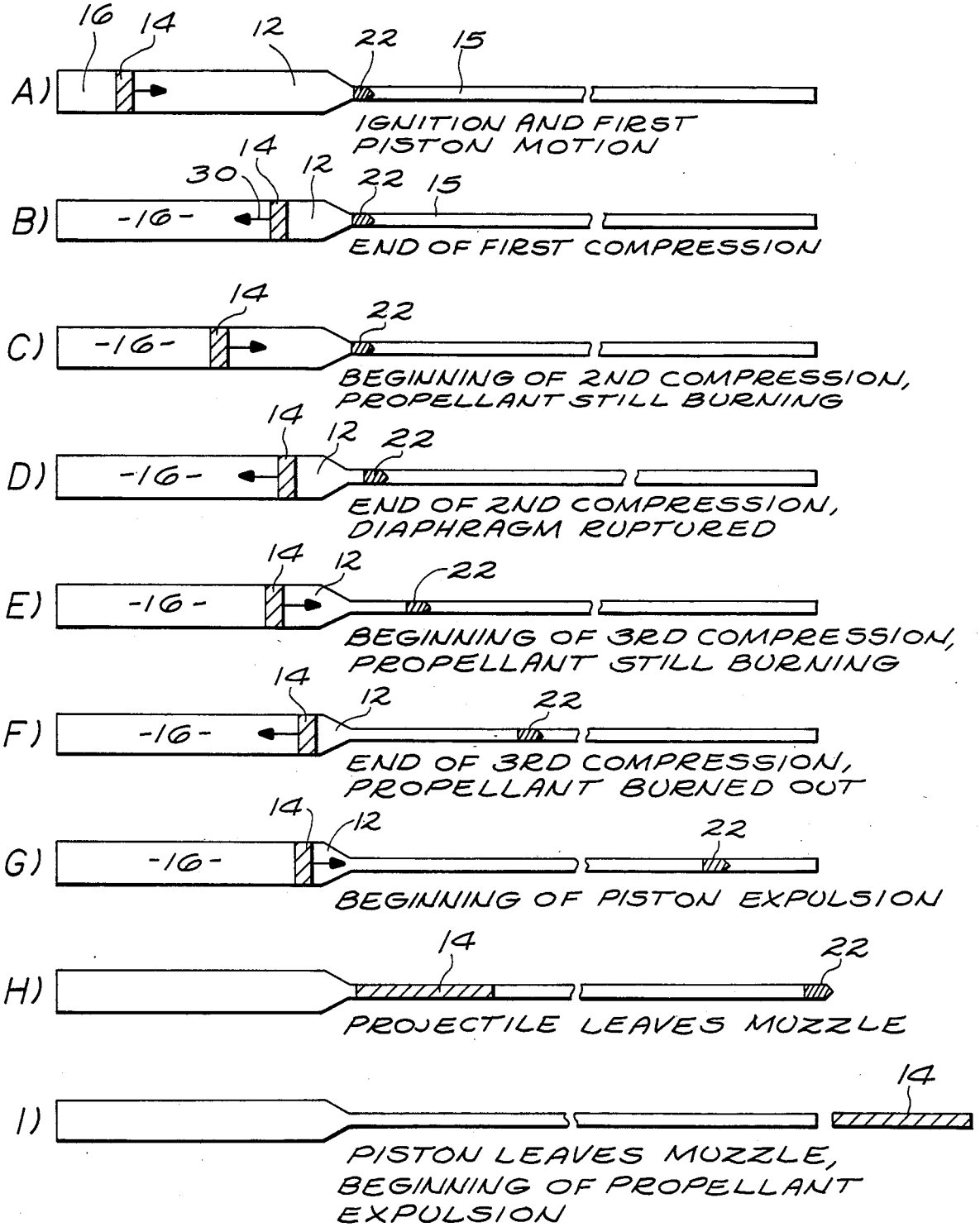

The operation of the gas gun herein is schematically illustrated in FIGS. 2A–I. In FIG. 2(A), the ignitiion phase operation is depicted. The ignition phase commences with the ignition of the first stage propellant 16 by ignitor 20 in response to a trigger signal. The resulting pressure increase on the rear side of the piston 14 causes piston 14 to move forward towards the distal end of pump tube 12.

The rear periphery of the piston may include a threaded region 23 which engages a threaded inner peripheral wall at the base of the pump tube. The threads are designed to shear when the pressure exerted by the first stage propellant reaches a positive shot start pressure on the order of 1 Kbar.

As the piston 14 moves forward, the first stage volume of the pump the behind the piston increases, lowering the pressure exerted by the burning first stage propellant. Simultaneously, the piston is compressing the second stage propellant 18 so that its pressure eventually exceeds the pressure behind the piston.

FIG. 2(B) illustrates the piston 14 at the end of its initial compression stroke at a position of maximum initial forward movement and zero forward velocity. The pressure on the forward side of the piston is greater than that on the rear side because of the inertia of the piston and/or adjacent gases. The piston accordingly moves backward, as illustrated by the arrow 30. In operation, on the order of 10% (namely in the range of 10% to 70%) of the first stage propellant has burned at the end of the initial compression stroke. This is distinctively different from a conventional two-stage gun wherein all the propallant has burned before the end of the first compression. Subsequent behavior is the result of the lightness of the piston and the continued burning characteristics of the propellant, resulting in a novel cycle that makes the cartridge concept of U.S. Pat. No. 3,326,084 practical. Accordingly, the first stage propellant 16 is still burning as the piston 14 moves backward initiating a period of sustained high mean pressure in the first-stage chamber. After the pressure on the rear of the region again becomes greater than the pressure exerted by the second stage propellant, the piston moves forward in a second compression stroke as depicted in FIG. 2(C).

As will be evident, the pattern of compression and backward movement can be repeated as many times as desired by controlling the amount and type of first stage propellant and by controlling the conditions under which the projectile is released. The movement of the piston will be a reciprocating one of declining magnitude and will generally yield progressively greater means pressures in the second stage propellant as it reaches progressively further forward positions in the pump tube. The plurality of compression strokes experienced by the piston is conveniently referred to as "pumping".

To ensure that the first stage propellant will burn sufficiently long to create the desired "pumping" action, a propellant with a relatively slow burning structure is preferably selected. Specifically, the first stage propellant is in sufficient density and quantity to burn relatively slowly with resulting relatively low kinetic energy throughout the multiple compression "pumping" action. The propellant should burn out just prior to the end of the last compression which provides useful propulsion forces on the projectile, as described hereafter.

The shear lip diaphragm 24 is designed to shear at a pressure reached in the second stage during a selected compression stroke, whereupon the projectile accelerates down the launch tube 15. In the described embodiment, the shearing takes place just prior to the end of the second compression stroke. In FIG. 2(D), the projectile has begun to accelerate down the launch tube, while the piston begins moving backwards owing again to the overshoot caused by its inertia.

As shown in FIG. 2(D), the expanding second stage volume behind the projectile (resulting from both piston and projectile motions) causes a pressure drop in the second stage propellant. The pressure in the second stage falls below the fist stage pressure, causing the piston to rapidly advance to the distal end of the pump tube in a third compression stroke, as illustrated in FIG. 2(E) and 2(F). The propellant 16 has burned out just prior to the end of the third compression stroke (FIG. 2(F)) which, in the illustrated embodiment is the last stroke providing a useful propulsion force. After moving backwards, due again to inertia-generated overshoot, the piston begins the terminal phase of the cycle (FIG. 2(G)) by traveling toward the convergence zone 32 where the launch tube interfaces with the housing.

Owing to the light weight of the piston, the frequency of "pumping" is sufficiently high and the position of the pumping piston sufficiently close to the convergence area that the successive compression waves generated by the piston after projectile release are directed down the launch tube and reach the projectile 22 before the projectile clears the launch tube. A substantial amount of additional velocity is imparted to the projectile by the successive compression waves. Because the pressures in the front and rear of the piston are oscillating around equivalence during the "pumping" phase of the piston, the piston need not impact with the convergence section of the pump tube and become damaged or cause damage to the gun.

The wave gun described above is suitable for weaponization because the low piston mass achievable through the use of the described ballistic cycle permits the use of cartridge configurations such as those described in U.S. Pat. No. 3,326,084 without sacrificing projectile velocity. While the foregoing description has been concerned with a preferred embodiment of the invention, it should be appreciated that there are numerous configurations and cycles possible employing a great variety of shapes and materials, number of compression strokes, timing of projectile release, propellant burning characteristics, etc.

For example, the ignitor 20 can be in the form of electric arc producing means when a chemical propellant is used.

Those skilled in the art will also recognize that the propellant described herein need not be a chemical type such as that described. For example, a material such as polyethelene or other plastic can be substituted for the chemical propellant 16 illustrated in FIG. 1 and evaporated by means such as an electric arc. The evaporating plastic expands within the first chamber to displace the piston 14 is taught herein.

As illustrated in FIGS. 2(H) and 2(I), the piston could be extruded through the launch tube by virtue of the high pressure behind it, thereby permitting a venting of first stage gases. Because of the deformable low mass of the piston, and its low-speed impact with the chamberage, the extrusion can occur without damage to the launcher.

The preceding description has presented, in detail, exemplary preferred ways in which the concepts of the present invention may be applied. Those skilled in the art will recognize that numerous alternatives encompassing many variations may readily be employed without departing from the spirit and scope of the invention as set forth in the appended claims.

I claim:

1. A two-stage gas launcher comprising:

a housing including a lunch tube section at its distal end;

barrier means in the housing for sealingly dividing the housing into first stage and second stge chambers of reciprocally variable volumes;

pressurizing means cooperating with said barrier means responsive to a trigger signal for causing a plurality of volumetric expansions of the first stage chamber culminating in a period of sustained high mean pressure therein;

trigger means for producing the trigger signal;

a low molecular weight gas disposed in the second stage chamber for compression by the volumetrically expanding first stage chamber; and a launchable mass positioned in the housing and responsive to the pressure of the compressed second stage gas to travel along the launch tube section and be launched from the distal end thereof;

means for releasably restraining the launchable mass within the housing so that it is launched during the period of sustained high pressure in the first stage chamber.

2. The launcher of claim 1 wherein the expansion-causing means includes means for producing an electric arc within the first stage chamber.

3. The launcher of claim 1 wherein the housing extends linearly.

4. The launcher of claim 1 wherein the launch tube section of the housing is of smaller internal diameter than the remaining portion of the housing.

5. The launcher of claim 1 wherein the housing is generally tubular.

6. The launcher of claim 5 wherein the housing is disposed about a central axis.

7. The launcher of claim 1 wherein the expansion-causing means includes a chemical propellant disposed within the first stage chamber.

8. The launcher of claim 7 wherein the chemical propellant is of a progressive grain structure.

9. The launcher of claim 7 wherein the chemical propellant has a structure which releases on the order of 10% of its energy during the first volumetric expansion of the first stage chanber.

10. The launcher of claim 1 wherein the barrier means includes a low mass piston.

11. The launcher of claim 10 wherein the piston is formed from a non-metallic material.

12. The launcher of claim 10 wherein the barrier means material is selected from the group consisting of plastic and elastomeric materials.

13. The launcher of claim 10 including an external thread formed about a portion of the piston's periphery, and an internal thread formed about the housing's internal periphery and adapted to engage the exterior thread of the piston, at least one of the interior and exterior threads being adapted to shear at a predetermined first stage pressure for releasably restraining piston movement subsequent to ignition of the chemical propellant until the pressure exerted by the propellant substantially reaches a predetermined value.

14. A cartridge for use in a two-stage gas launcher comprising:

a generally tubular housing having a launch end;

barrier means for sealingly dividing the housing into first and second stage chambers of reciprocally variable volumes;

propellant means disposed within the first stage chamber and ignitable to cause a plurality of volumetric first stage expansions culminating in a period of sustained high mean pressure therein, thereby displacing the barrier means;

ignition means responsive to a trigger signal for igniting the propellant;

a low molecular weight gas disposed within the second stage chamber for compression by the displaced barrier means;

a launchable mass releasably restrained in the launch end of the housing and positioned to be acted on by the compressed second stage gas; and means for releasing the launchable mass at a suitable compression of second stage.

15. The cartridge of claim 14 wherein the mass of the barrier means is sufficiently small to produce at least one successive compression wave after projectile release which overtakes the projectile before projectile launch.

16. The cartridge of claim 14 wherein the releasing means releases the mass so that it is launched from the launcher during the period of sustained high mean pressure.

17. A method for launching a mass comprising the steps of:

(a) sealingly dividing a housing into first stage and second stage chambers having reciprocally varying volumes with a barrier member mounted for reciprocating movement;

(b) placing a gas of low molecular weight in the second stage chamber;

(c) expanding the first stage volume a plurality of times culminating in a period of sustained high mean pressure therein so as to compress the second stage volume a plurality of times;

(d) restrainably positioning a launchable mass for acceleration by the compressed gas down a launch tube;

(e) launching the mass during the period of high sustained mean pressure in the first-stage chamber.

18. The method of claim 17 including the step of overtaking the mass with a secondary compression wave before it leaves the launch tube.

19. The method of claim 17 including the step of placing a sufficient quantity of chemical propellant of appropriate grain structure in the first stage chamber so that the propellant burns during a plurality of volumetric expansions of the first stage chamber.

20. The method of claim 19 including the step of releasing the mass no sooner than during the second volumetric expansion of the first stage chamber.

21. A two-stage gas launcher comprising:

a housing including a launch tube section at its distal end;

barrier means in the housing for sealingly dividing the housing into first stage and second stage chambers of reciprocally variable volumes;

means responsive to a trigger signal for causing successive volumetric expansions of the first stage chamber;

trigger means for producing the trigger signal;

a low molecular weight gas disposed in the second stage chamber for compression by the volumetrically expanding first stage chamber;

a launchable mass positioned in the housing and responsive to the pressure of the compressed second stage gas to travel along the launch tube section and be launched from the distal end thereof;

means for releasably restraining the launchable mass within the housing;

timing means for releasing the launchable mass near the end of at least the second compression stroke.

22. A two-stage gas launcher comprising:

a housing including a launch tube section at its distal end;

barrier means in the housing for sealingly dividing the housing into first stage and second stage chambers of reciprocally variable volumes;

pressurizing means cooperating with said barrier means and responsive to a trigger signal for causing a plurality of volumetric expansions of the first stage chamber culminating in a period of sustained high means pressure therein;

trigger means for producing the trigger signal;

a low molecular weight gas disposed in the second stage chamber of compression by the volumetrically expanding first-stage chamber;

a launchable mass positioned in the housing and responsive to the pressure of the compressed second-stage gas to travel along the launch tube section and be launched from the distal end thereof; and means for releasably restraining the launchable mass within the housing so that it is launched no sooner than during the second compression of the second stage volume.

* * * * *

UNITED STATES PATENT AND TRADEMARK OFFICE

CERTIFICATE OF CORRECTION

PATENT NO. : 4,658,699

DATED : April 21, 1987

INVENTOR(S) : Thomas J. Dahm

It is certified that error appears in the above—identified patent and that said Letters Patent is hereby corrected as shown below:

Column 2, line 37: "pro-loaded" should be -- pre-loaded--

Column 4, line 64: "the" should be --tube--

Column 5, line 32: "means" should be --mean--

Column 6, line 41: "is taught" should be --as taught--

Column 6, line 58: "lunch" should be --launch--

Column 6, line 61: "stge" should be --stage--

Signed and Sealed this

Twenty-fifth Day of August, 1987

*Attest:*

DONALD J. QUIGG

*Attesting Officer*

*Commissioner of Patents and Trademarks*